United States Patent [19]

Bergman

[11] Patent Number: 4,633,781

[45] Date of Patent: Jan. 6, 1987

[54] SHOTGUN GAUGE ADAPTER

[76] Inventor: Gustav A. Bergman, Le Mas de Tanit, Karalys No. 2198, F-06160 Juan-les-Pins, France

[21] Appl. No.: 654,261

[22] Filed: Sep. 25, 1984

[30] Foreign Application Priority Data

Oct. 3, 1983 [SE] Sweden ..... 8305418

[51] Int. Cl.[4] ..... F42B 8/00

[52] U.S. Cl. ..... 102/446

[58] Field of Search ..... 42/77; 102/446

[56] References Cited

U.S. PATENT DOCUMENTS

| | | | |
|---|---|---|---|
| 1,179,021 | 4/1916 | Mayer | 102/446 |
| 2,641,860 | 6/1953 | Dial | 42/77 |
| 2,898,694 | 8/1959 | Senutovitch | 42/77 |
| 3,156,995 | 11/1964 | Mellor et al. | 42/77 |
| 3,196,569 | 7/1965 | Thomason | 42/77 |
| 4,126,954 | 11/1978 | Plummer | 42/77 |

FOREIGN PATENT DOCUMENTS

| | | | |
|---|---|---|---|
| 957192 | 1/1957 | Fed. Rep. of Germany | 42/77 |
| 111243 | 7/1944 | Sweden . | |
| 4145 | of 1895 | United Kingdom | 102/446 |

*Primary Examiner*—Deborah L. Kyle
*Assistant Examiner*—Ted L. Parr
*Attorney, Agent, or Firm*—Young & Thompson

[57] ABSTRACT

A gauge adapter for a break-action shotgun, including a bullet barrel fixed in a plug having the dimensions of the shot cartridge. The adapter includes a resilient pressure device, disposed for pressing the plug solidly against the wall of the transition cone in the shot bore when the fire-arm is closed. The forward part of the plug has a rounded breast for bearing against the transition cone, the radius of the breast corresponding to the cylindrical radius of the plug. The breast thus acts in the transition cone as the ball in a ball joint. The resilient pressure device can be an elastomeric pressure pad disposed in a practically cylindrical cavity in the rear face of the plug. The pressure pad is outwardly covered by a plate extending up to half the bullet barrel and has a cut-out for the bullet cartridge. In the area of the cartridge rim, the plate has a depression for engaging under the rim of the cartridge. When the fire-arm is opened, the plate acts as a shell extractor so tht the shell can be gripped and taken out with the aid of a finger nail.

10 Claims, 4 Drawing Figures

SHOTGUN GAUGE ADAPTER

The present invention relates to a gauge adapter, particularly for firing a bullet cartridge in a break-action fire-arm, the bore and cartridge chamber of which are intended for a shot cartridge, including a plug with the dimensions of the shot cartridge, and a bullet barrel fastened into the plug.

BACKGROUND OF THE INVENTION

1. Field of the Invention

Such adapters have been known for a long time. They are usually made for a bullet cartridge designated 0.22 LR (5.6×15 mm) with rim fire, the bullet barrel being excentrically disposed in the plug, parallel to the axis of the plug.

The adapter and its comparatively underpowered bullet cartridge are usually used for killing at short range still living felled game, in certain cases instead of a special pistol when hunting fox and badger, as well as in hunting varmint (crows, gulls, mink, rats etc.).

A short firing range does not require particularly high precision or a close hit pattern. The adapter can be short and the play between the plug and the cartridge chamber may be comparatively large without spoiling the result. Simple adapters according to the introduction can be quite satisfactory. As only one round generally needs to be fired in one connection, a shell extractor for the fired cartridge is usually lacking. After firing, the marksman takes the adapter out and knocks out the shell with a rod of some kind.

A problem is that shots at a longer range e.g. at sitting birds, require higher precision. The hits must sit well collected, e.g. within a circle of 25 mm diameter at 50 meters. In addition, the hit center must as closely as possible correspond to the point aimed at by the normal sighting gear of the weapon. Only in exceptional cases does an adapter according to the introduction meet these demands. The play of the plug in the cartridge chamber gives a wide spread to the shots. The barrels in a double-barreled shotgun are usually directed convergingly (as with a double-barreled sporting gun), which results in that an adapter in a left bore throws to the right, in a right bore to the left, in an upper bore below and in a lower bore above the sighting point.

2. Description of Related Prior Art

Attempts have oeen to solve at least some of these problems. The U.S. Pat. No. 2,641,860 thus describes a long adapter with a parted plug, the forward part being glidable about the bullet barrel and provided with a forward conical portion for engagement against the wall in the transition cone between the shot bore and the cartridge chamber. The glidability allows adjustment of the plug for cartridge chambers of different lengths. After adjustment the conical portion may be locked against the bullet barrel. The bullet barrel is also guided in the shot bore with the aid of three spaced bushes and four leaf springs which are radially adjustable at the central bush with the aid of set screws for setting the bullet barrel in correct alignment in the shot bore.

The construction of the known adapter is thus very complex and expensive. The alignment is also difficult for the user, and probably causes wide hit spread, since the three bushes at the ends and at the middle of the barrel, as well as the leaf springs, disturb the oscillation pattern of the bullet barrel in shooting in a manner difficult to control. It has been known for a long time that a bullet barrel shall be rigidly clamped at the chamber and otherwise free so that the barrel oscillations will be reproduced alike from shot to shot.

SUMMARY OF THE INVENTION

The invention solves the problem simply with the aid of an adapter according to the introduction, the primary distinguishing feature of which is that a pressure means is arranged to act against the breech face of the fire-arm for urging the forward portion of the plug against the wall in the transition cone of the cartridge chamber for fixing the position of the plug from shot to shot.

The greater the force of the pressure means against the breech face is, the greater will be the friction between the forward portion of the plug and the transition cone wall, and thereby the fixation of the plug position. The pressure means can take the form of an elastomeric pad, arranged in a cavity in the rear part of the plug so that in an unloaded condition it projects somewhat outside the rear face of the plug and is compressed by the breech face of the fire-arm when it is closed.

The cavity is suitably cylindrical and concentric with the plug. The pad has a corresponding shape but is cut away along a chord through the bullet barrel, and is also cut away to accommodate the bore of the bullet barrel. The area of the pad is somewhat smaller than the bottom area of the cavity so that the cavity leaves room for compression of the pressure pad. The pad is suitably made from an age-resistant elastomer, e.g. nitril rubber, and is glued onto the bottom of the cavity.

In a suitable embodiment, a plate of hard metal, e.g. stainless steel, is attached to the outside of the pad. The plate may have an axially directed edge flange, which also engages against the cavity in the outer position of the plate and when pressure comes on the plate it forms a guide for the plate against the whole or a greater portion of the cylindrical wall of the cavity. The plate has an arcuate impression extending along the position of the cartridge in the bullet barrel, the form of the depression corresponding to the projecting edge or flange of the cartridge shell. The plate serves as an anvil in respect of the firing pin for rim fire cartridges and as an extractor for all kinds of cartridges. The edge of the pushed-out rim of the shell is then free to be gripped by a finger nail at the portion of the cavity which is not covered by the pad and plate.

The pressure means may also have the form of a push rod actuated by a compression spring, the rod being movable between an outer position where its rear end projects outside the rear face of the plug, and an inner position where the push rod may slide in a bore in the plug practically parallel to the axis of the plug.

In a suitable embodiment, the rear part of the push rod is provided with a claw directed towards the bullet bore, the claw being guided in a complementary cavity in the rear portion of the plug and adapted to extract the bullet cartridge shell by spring bias when the fire-arm is opened.

The outer position of the push rod is suitably determined by a stop means thrusting into a bore in the plug, e.g. a pin, a hook or a set screw, which rests against an abutment on the push rod in the outer position of the rod. This abutment can be formed by the inner end wall in an elongate slot along the rod, and the stop means can be a pin engaging in the slot. In its simplest form the pin is a smooth, cylindrical body. When the push rod is in its outer position, the stop pin is retained by the friction from the spring bias. When the fire-arm is closed and the push rod is pressed inwards, the stop pin is retained by the chamber wall.

In a suitable embodiment, the forward portion of the plug, at least in the contact area with the chamber transition cone, has the form of a sphere, the radius of which generally conforms to the cylinder radius of the plug. This embodiment results in that the plug functions as a ball joint in the transition cone, within the play between the chamber and the plug, i.e. it allows the minor tilting made possible by the play.

Since the push rod is eccentrically disposed in the plug, its pressure against the breech face will cause such tilting. This in turn permits that rotation to a suitable angular position of the plug in the shot cartridge chamber can compensate for possible errors in the hit position during shooting. When the hit position is correct, the user makes a mark on the rear face of the plug so that the right rotational position of the plug is completely reproducible.

In a particularly suitable embodiment, the plug is produced by molding in a mold a plastics material in a manner known per se, the bullet barrel being disposed in the mold so that after molding it is fixed with its axis parallel to that of the plug. Before molding, the exterior of the barrel is provided with grooves, e.g. a few shallow turning grooves, possibly crossing thread grooves, for completely fixing the barrel in the molding composition. The plastics material may also be blended with reinforcing fibers, e.g. glass-fibers.

Particularly in the manufacture of small batches of adapters in accordance with the invention, e.g. for suiting the cartridge position in less usual shotguns, a special embodiment of the mold may be suitable. According to this embodiment, the mold is quite simply an empty shell used in the weapon in question, suitably a plastics shell, an opening for the barrel being made in the base of the shell, which forms the outside of the plug after molding.

Particularly in the cases where the adapter in accordance with the invention is intended for use in a fire-arm with a spring-biased shell ejector, an elastomeric ring is suitably arranged around the circumference of the plug to prevent, with the aid of friction against the chamber wall, any movement of the adapter when the weapon is opened after a shot. The ring can extend as a sleeve along the whole or part of the plug, or may be an O-ring elastically disposed in a grooved in the plug.

BRIEF DESCRIPTION OF THE DRAWINGS

The invention is described in the following with the aid of some embodiments and with reference to the accompanying drawing, in which.

DETAILED DESCRIPTION OF THE DRAWINGS

Figure 1:
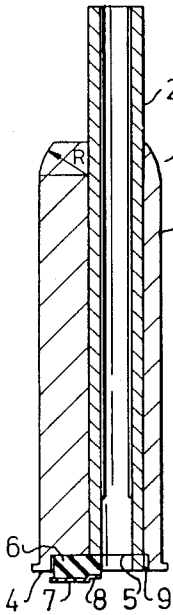
FIG. 1 is an axial section through a first embodiment of the adapter according to the invention.

The adapter in FIG. 1 includes a bullet barrel 2, which is fixed in a shot cartridge-like plug 3 of metal or plastics material. The barrel 2 is intended for a rim-fire 0.22 bullet cartridge (5.6×15 mm) and is therefore eccentrically arranged in the plug so that the firing pin (not illustrated) of the fire-arm will strike the rim of the bullet cartridge.

In the rear face 4 of the plug, a cylindrical cavity 5 is coaxial with the plug 3. Due to the eccentric position of the barrel in the plug, the barrel will divide the rear face, transverse the plane of symmetry, into a larger portion and a small narrow portion.

Figure 2:
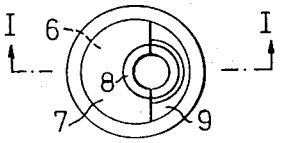
FIG. 2 is a view of the bottom face of the adapter in FIG. 1, FIG. 3 in the same way as FIG. 1 illustrates a second embodiment of the adapter, and FIG. 4, as in FIG. 2, illustrates its rear face.

A pressure pad 6 of nitril rubber is glued to the bottom of the cavity 5. The pad projects one or a few millimeters outside the rear face. The pad 6 has a somewhat smaller diameter than the cavity, thus providing the latter with space to take up the volume of the pad when it is compressed. The pad 6 extends to the vicinity of the middle of the bullet barrel as illustrated in FIG. 2. On the outside of the pad 6 there is a plate 7 glued or vulcanized to the pad. The plate 7 is of a hard material, e.g. stainless steel. In the area for the cartridge chamber in the barrel 2, the plate 7 has an impression 8, arranged to engage under the flange or rim of the bullet cartridge.

When the fire-arm is closed over the adapter, the pressure pad 6 is compressed axially and the bullet cartridge is taken into the cartridge chamber in the bullet barrel 2, the inside of the impression 8 on the plate 7 resting against an abutment in the cartridge chamber of the barrel and forms an anvil for the firing pin strike against the cartridge rim. When the fire-arm is opened the shell is pressed by the pressure pad 6 via the plate 7 out from its firing position so that its rim is grippable by a finger nail in the portion 9 of the cavity 5 which is not covered by pad and plate.

Figure 4:
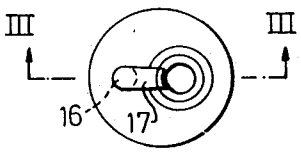
Figure 3:
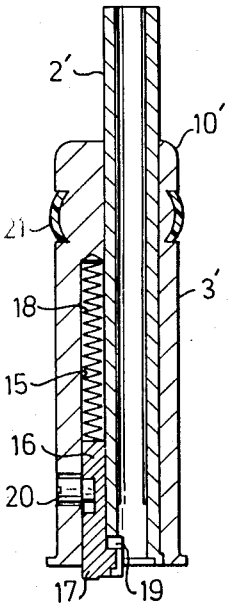

FIGS. 3 and 4 illustrate a second embodiment of the adapter according to the invention. As with the embodiment in FIGS. 1 and 2, it includes a bullet barrel 2' and a plug 3' of metal or plastics with a rear face 4.

The pressure means is here a push rod 16, however, which is provided at its rear end in the illustrated embodiment with a claw 17 for extracting the shell. The push rod 16 is axially movable in a bore 15 in the plug under the action of a powerful compression spring 18, which presses the push rod backwards/outwards. The claw 17 is guided in a complemental cavity 19, which prevents rotation of the push rod and claw. A slot is made in the push rod, and the ends of this slot form abutments for a set screw 20 threaded into an opening in the plug wall.

The working mode of the pressure means for the embodiment in FIGS. 3 and 4 is analogous with that in FIGS. 1 and 2.

The plugs in FIGS. 1 and 2 as well as 3 and 4 forwardly terminate with a breast 10'. The breast 10' has generally the shape of a forwardly truncated hemisphere, with a radius R corresponding to the cylinder radius of the plug. In the transition cone of the fire-arm, the breast therefore rests tangentially along an unbroken circle against the cone wall and thus acts as a ball in a ball joint permitting the plug in the play between plug and chamber to reproducibly incline the axis of the bullet bore to that of the shot bore. Rotation of the plug enables the user to find a suitable position which gives the right bullet hit position.

The adapter illustrated in FIG. 3 is intended for use in a fire-arm with a so-called ejector, which automatically ejects the shell from a bore, the striking spring of which has been released. To prevent this happening with the adapter, its plug is provided with an elastomeric ring, arranged in a groove around the plug. The ring projects somewhat outside the cylindrical surface of the plug and thus causes friction between the plug and the chamber wall. The friction is sufficiently great to prevent the adapter being ejected. The ring may be implemented in other ways than the one illustrated; it may be an O-ring, for example.

I claim:

1. In a shotgun gauge adapter for firing a bullet cartridge, said adapter being for use in a breech-action fire-arm having a gauge, bore and cartridge chambers adapted to receive a shot cartridge, and a breech face, said adapter comprising a plug having the dimensions of the shot cartridge and a bullet barrel fixed in the plug; the improvement in which the bullet barrel is mounted eccentrically in the plug, parallel to the axis of the plug, a portion of the bullet barrel extending out of the plug a lesser distance than the length of the plug, said barrel having an outer diameter smaller than said gauge of the fire-arm into which it is to be inserted, the plug being provided at its rear end with a resilient pressure means that is so disposed as to act against the breech face of a closed fire-arm for pressing the forward portion of the plug against the wall in a transition cone of the cartridge chamber for fixing the position of the plug in the cartridge chamber from shot to shot, said forward portion of the plug having a spherically shaped breast region for seating against said transition cone.

2. Adapter as claimed in claim 1, characterized in that the pressure means is an elastomeric pad disposed in a cavity in the rear portion of the plug.

3. Adapter as claimed in claim 2, characterized in that a cut-out in the pad uncovers the rear opening of the bullet barrel and a portion of the cavity adjacent the bore of the bullet barrel, and in that a plate of hard metal is fastened to the outside of the pad, the plate in the area of the bore having an impressed part adapted for engaging under the shell rim for withdrawing the shell when the fire-arm is opened.

4. Adapter as claimed in claim 1, characterized in that the pressure means is a push rod activated by a compression spring, the rod being movable between an outer position and an inner position in a cavity in the plug generally parallel with the axis of the plug.

5. Adapter as claimed in claim 4, characterized in that the rear part of the push rod has a claw directed towards the bullet barrel, and which is guided in a complemental cavity in the rear portion of the plug and adapted to withdraw the shell of the bullet cartridge when the fire-arm is opened.

6. Adapter as claimed in claim 4, characterized in that the outer position of the push rod is determined with the aid of a stop means thrusting into a bore in the plug, said means engaging against an abutment on the push rod in the outer position of the rod.

7. Adapter as claimed in claim 1, characterized in that the forward portion of the plug at least in the contact area with the transition cone of the chamber has the form of a sphere, the radius of which generally corresponds to the cylinder radius of the plug.

8. Adapter as claimed in claim 1, characterized in that the plug is produced by molding a plastics material in a mold, the bullet barrel being disposed in the mold for molding into the plug.

9. Adapter as claimed in claim 8, characterized in that the plastics material is mixed with reinforcing fibers such as glass-fibers.

10. Adapter as claimed in claim 1, particularly for use in a fire-arm provided with a shell ejector, characterized in that an elastomeric ring is arranged around the circumference of the plug for preventing, with the aid of friction against the chamber wall, the ejection of the adapter after a shot.

* * * * *